United States Patent [19]

Swenson

[11] 4,076,171

[45] Feb. 28, 1978

[54] DAMPER CONTROL APPARATUS

[76] Inventor: Paul F. Swenson, 25525 Edgecliff Drive, Euclid, Ohio 44132

[21] Appl. No.: 704,548

[22] Filed: Jul. 12, 1976

[51] Int. Cl.[2] ..... F23N 3/02

[52] U.S. Cl. ..... 236/1 G; 91/400; 126/285 R; 137/98; 137/510; 236/80 B; 431/20

[58] Field of Search ..... 91/400; 236/2 G, 16, 236/80 B; 431/20; 126/285 R; 137/510, 87, 98

[56] References Cited

U.S. PATENT DOCUMENTS

| | | | |
|---|---|---|---|
| 1,336,937 | 4/1920 | Allman | 126/351 |
| 1,813,395 | 7/1931 | Fraser | 236/1 G |
| 2,112,554 | 3/1938 | Beam | 431/20 |
| 2,130,491 | 9/1938 | Gilliland | 431/20 |
| 2,321,423 | 6/1943 | Rogers | 91/400 X |
| 2,852,032 | 9/1958 | Moore | 137/98 |

*Primary Examiner*—William E. Wayner
*Assistant Examiner*—William E. Tapolcai, Jr.
*Attorney, Agent, or Firm*—Daniel G. Blackhurst

[57] ABSTRACT

An apparatus for opening and closing the draft hood discharge opening and vent and fuel line of a fluid fuel-fired heating device such as a domestic water heater. The disclosed apparatus includes a diaphragm-type expansible chamber fluid motor assembly positioned in the burner fuel supply line. The motor assembly is mechanically linked to a damper assembly such that the supply of pressurized fuel acts to actuate the motor for opening the damper assembly prior to the motor assembly admitting fuel to the burner. Additionally, when the supply of fuel is terminated, the motor assembly does not close the damper assembly until after the motor assembly stops fuel to the burner.

14 Claims, 3 Drawing Figures

DAMPER CONTROL APPARATUS

BACKGROUND OF THE INVENTION

The subject invention is directed toward the art of heating apparatus and, more particularly, to a vent or stack damper control system for a combustion-type heating apparatus.

The invention is particularly suited for use on gas-fired water heaters and will be described with reference thereto; however, the invention is capable of broader application and could be used on many different types of fluid fuel-fired furnaces, boilers and similar heating devices.

The typical domestic hot water heater comprises a vertically-extending tank with a central vent tube positioned axially thereof. A gas burner is positioned beneath the tank and is controlled by a thermostatic valve responsive to the temperature of the water within the tank. The water within the tank is, of course, heated by the hot combustion products impinging against the bottom of the tank and traveling through the vent tube. Generally, the exit end of the vent tube is connected through a draft hood with a chimney or stack to convey the combustion products to a location exterior of the building.

The general arrangement described above is in widespread use. One of the major disadvantages is, however, a comparatively low, overall thermal efficiency. For example, during those periods when the burner is not firing, natural thermosyphonic action induces a continual flow of air through the vent tube and up the stack. This causes thermal losses in terms of loss of heated air from the building and cooling of the heated water in the tank. The natural cooling of the heated water causes the burner to be cycled on-and-off even during periods when no heated water is being used.

Various approaches for overcoming the noted losses have been proposed in the prior art. For example, see the following U.S. Pat. Nos.:

Allman, 1,336,937;
Stinson, 1,959,970;
Gilliland, 2,130,491;
Firehammer, 2,179,120;
Woods, 2,218,061;
Stringer, 2,224,705;
Viola, 2,557,210;
Hodgins, 3,010,451.

Generally, the systems shown in the noted patents are unsatisfactory for at least one of several reasons. That is, the systems are either complex, cumbersome, and expensive and/or they require an electrical supply. In addition, the prior systems generally do not provide any means for preventing losses due to heated building air entering the draft hood and going up the chimney.

Because of the problems and disadvantages of the prior systems, they have generally not been suitable for commercial applications either as original equipment or as retrofit units for incorporation in existing equipment.

BRIEF DESCRIPTION OF THE SUBJECT INVENTION

The subject invention provides an apparatus which overcomes the problems of prior systems and allows both the heating appliance vent pipe or draft hood to be closed in coordinated relationship with the operation of the burner. In particular, according to one aspect of the invention, a heating apparatus of the type having a fluid fuel burner, a vent pipe for discharging the products of combustion produced by the burner and a valved supply line for supplying pressurized fluid fuel to the burner is provided with the improvement which includes at least one damper means movable between open and closed positions for controlling flow through the vent pipe. An expansible chamber motor means is connected with the damper means for moving it to an open position when pressurized fluid is supplied to the motor means. Additionally, a connection is provided for depressurizing the motor means whenever the valve means is in a closed position.

Preferably, and in accordance with a further aspect of the invention, means are also provided for preventing the flow of fuel to the burner until the damper means are in an open position. These means generally comprise a valve element operated by the fluid motor after the damper means have been moved to an open position.

OBJECTS OF THE INVENTION

Accordingly, a primary object of the invention is the provision of a simple and reliable apparatus for preventing heat losses from a fluid fuel-fired heating apparatus when in a standby mode of operation.

Another object is the provision of an apparatus of the general type described which operates without the need of an electrical power supply.

Still another object is the provision of a damper control apparatus which is comparatively simple in construction and can be installed in new equipment or retrofitted to existing equipment.

Still another object is the provision of an apparatus of the general type described wherein the dampers are open well prior to the firing of the burner and close slowly after burner operation ceases.

A still further object of the invention is the provision of a system of the type under consideration wherein all power required for operating the system is obtained from the pressure of the fuel being supplied to the burner.

BRIEF DESCRIPTION OF THE DRAWINGS

The above and other objects and advantages will become apparent from the following description when read in conjunction with the accompanying drawings wherein.

DETAILED DESCRIPTION OF THE DRAWINGS

Figure 1:
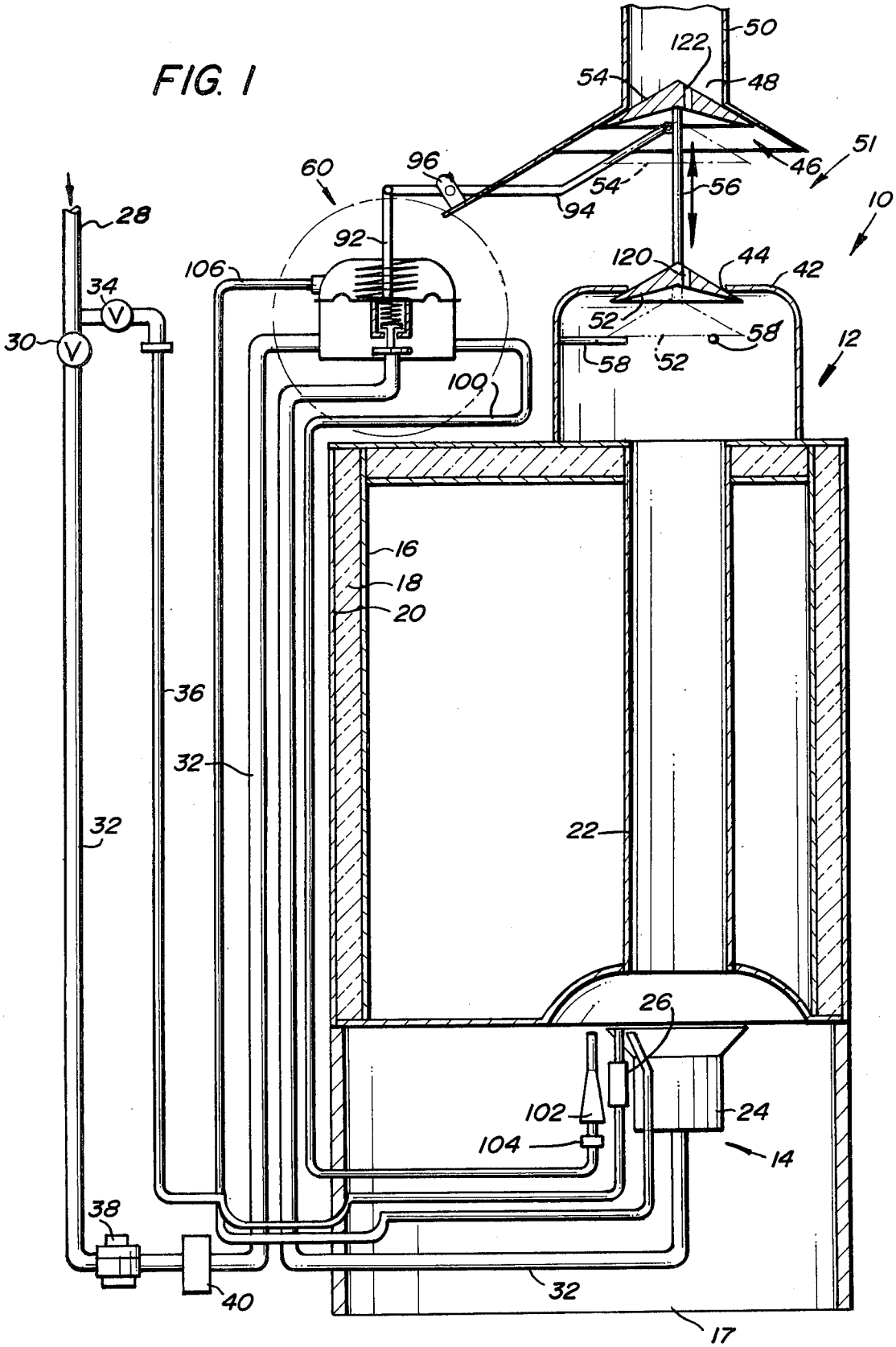
FIG. 1 is a somewhat diagrammatic view showing the overall arrangement of a damper control system formed in accordance with the subject invention.

Referring in particular to the drawings wherein the showings are for the purpose of illustrating a preferred embodiment of the invention only, and not for the purpose of limiting same, FIG. 1 shows, in diagrammatic form, a comparatively conventional domestic-type hot water heating unit 10 including a water storage tank unit 12 and a burner assembly 14. The tank assembly 12 comprises a generally cylindrical storage tank 16 supported from a base 17 and provided with water supply and discharge connections not shown. The tank 16 is suitably insulated by insulation 18 covered by a sheet metal housing or shell 20.

Extending vertically through the tank 16 is a vent tube 22 which serves to discharge the products of combustion produced by the burner assembly 14 and, also, to conduct heat to the water within the tank 16.

The apparatus thus far described is conventional and, as mentioned earlier, produces certain inherent thermal inefficiencies. For example, during the period when the burner is not firing, the heated water within tank 16 tends to produce natural thermosyphonic action with respect to the flue tube 22. That is, the air column within the flue 22 is heated and rises causing a constant flow of air vertically through the flue tending to cool the water. Consequently, even though the tank is insulated, a substantial heat loss takes place from the water and, as a result, the burner is required to periodically cycle on-and-off to maintain the desired water temperature even though no hot water is being withdrawn from the tank.

The subject invention provides a system whereby the heat losses through the noted thermosyphonic action can be reduced and substantially eliminated. Specifically, as shown, the apparatus includes a discharge plenum or chamber 42 positioned at the outlet end of flue 22. A central discharge opening 44 is formed in the plenum 42 for permitting the flow of combustion products to enter the inlet 46 of a draft hood 48. As is customary, the draft hood 48 is connected through an outlet duct 50 with a chimney or stack (not shown) for conducting the products of combustion exteriorly of the building. According to the subject invention, damper means 51 are provided for operation to close off the outlet from the flue tube 22, as well as the inlet opening to the draft hood whenever the main burner 14 is not operating. While the damper means 51 could take a variety of constructions within the scope of the invention, it is specifically shown as including a first damper member 52 arranged to move from an outlet closing position shown in solid lines to an outlet open position shown in phantom. A second damper member 54 is arranged to close the draft hood discharge opening and move from the closed or solid-line position to the open or phantom position. In the subject embodiment, the dampers 52 and 54 are positively interconnected by a vertical rod 56. Downward movement of the dampers 52 and 54 is limited by rods or stop members 58 which extend inwardly from the walls of the plenum 42.

Figure 2:
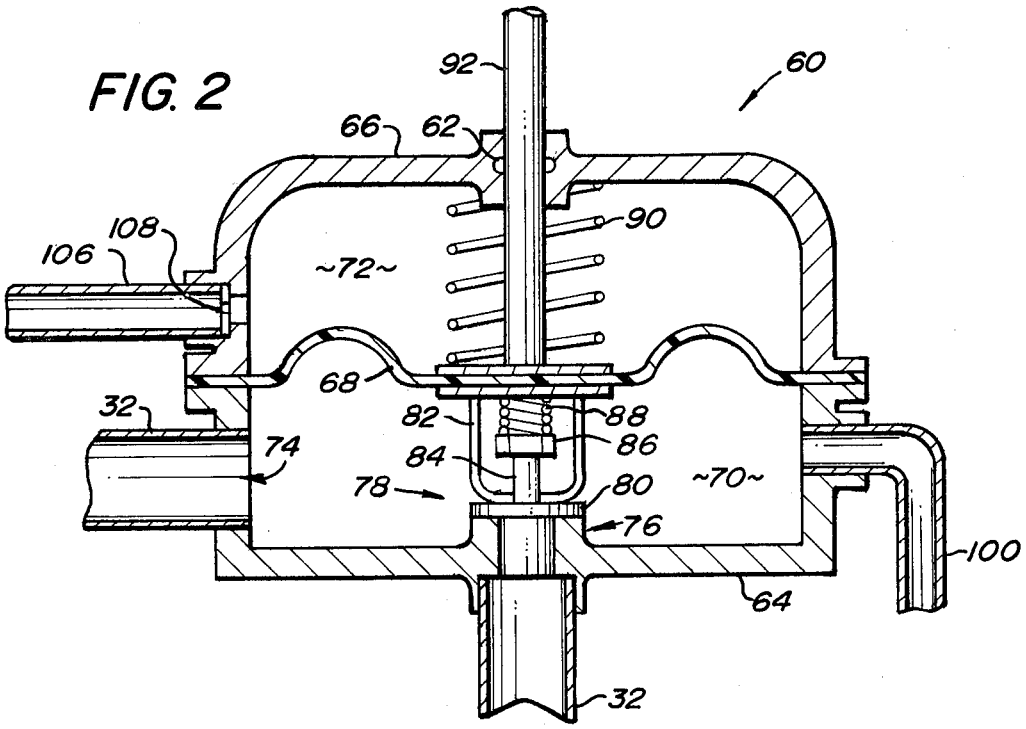
FIG. 2 is an enlarged view of the circled area of FIG. 1 showing in detail the preferred construction of the damper actuation and control assembly; and, FIG. 3 is a view similar to FIG. 2 but showing the apparatus in a position to maintain the damper assembly in its open condition.
Figure 3:
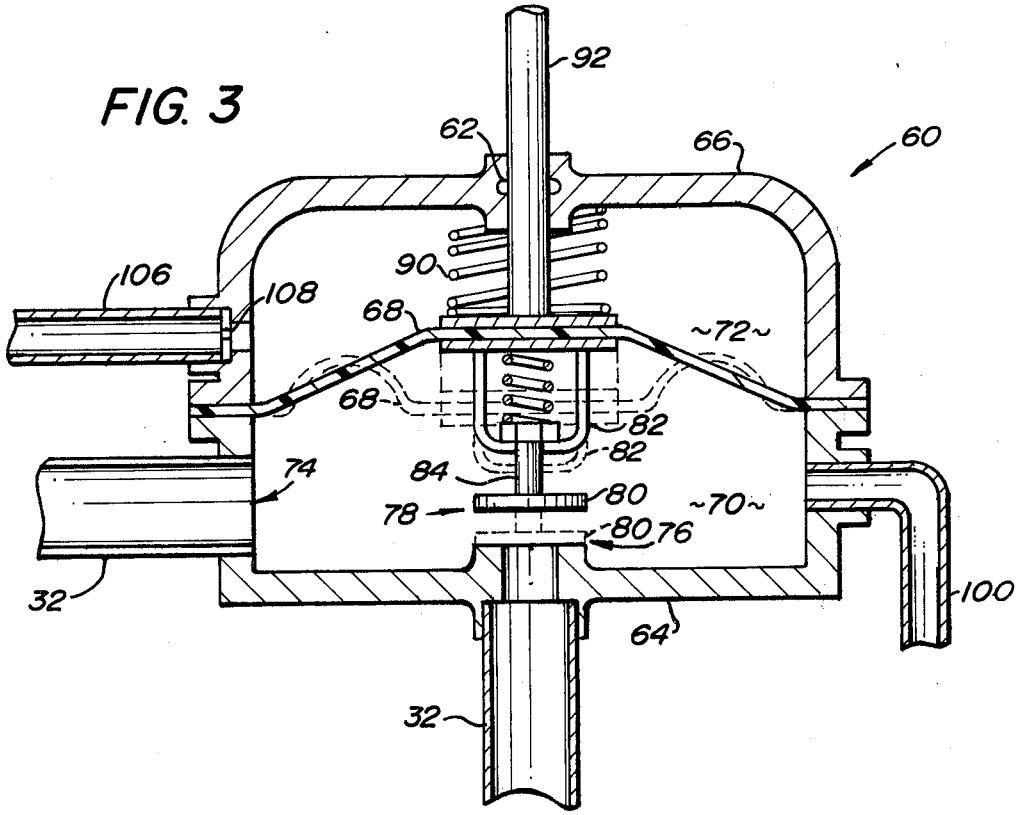

Of particular importance to the subject invention is the arrangement whereby the dampers 52, 54 are moved in coordinated relationship with the firing of main burner assembly 14. In particular, according to the subject invention, an expansible chamber motor means 60 is positioned in the main gas supply line 32 between the control valve 40 and the gas burner 24. The expansible chamber motor means 60 could have many specific constructions; however, the preferred construction is best seen in FIGS. 2 and 3. Referring in particular to FIG. 2, it will be noted that the expansible chamber motor means 60 preferably includes a lower chamber-defining section 64 and an upper section 66. Clamped in sealed relationship between housing sections 64 and 66 is a flexible diaphragm member 68 which divides the interior of the housing into a sealed lower chamber 70 and an upper chamber 72. The housing assembly is connected to the main gas supply line 32 and enters the lower chamber 70 at an inlet opening 74 and leaves the chamber at an outlet opening 76.

A valve assembly 78 is positioned to control the flow through the outlet opening 76. As shown, the valve assembly 78 includes a valve member 80 carried and guided by a member 82 which extends downwardly and is supported from the diaphragm 68. The valve 80 includes an upwardly-extending shaft portion 84 which is slidably received in the lower wall of the support 82. A stop member 86 is mounted at the upper end of the shaft 84 for engagement with the bottom wall of support 82. The valve member 80 is maintained under a continual downward bias by a comparatively light compression spring 88 positioned between the diaphragm 68 and the top of stop member 86.

The diaphragm member 68 is also maintained under a light, continual downwardly-directed bias by a compression spring 90 positioned between the top housing section 66 and the top surface of the diaphragm 68. Additionally, as will be noted, an actuating rod 92 extends upwardly through the seal means 62 from the diaphragm 68 into pivotal engagement with a lever 94 mounted for rocking movement about a pivot support 96 carried from the draft hood 48 (see FIG. 1). The right-hand end of the lever 94 is pivotally connected to the vertically-extending shaft 56 between the dampers 52, 54.

OPERATION OF THE PREFERRED EMBODIMENT

The operation of the apparatus thus far described will now be explained. Assume that valves 30 and 34 are in their normally open position and that the pilot burner 26 is operating. When valve 40 is opened, indicating a need for operation of the main burner 24, gas enters the lower chamber 70 of the expansible chamber motor means 60. Upon pressurization of chamber 70, the diaphragm 68 is actuated upwardly from the dotted-line position of FIG. 3. This, of course, causes the actuating rod 92 to move upwardly and fully open the dampers 52, 54. It should be noted that until the movement of the diaphragm causes support member 82 to lift stop member 86, the valve 80 is still seated against the outlet 76. Consequently, the dampers are open but no gas can flow through the outlet 76 to the burner 24. Continued upward movement of the diaphragm 68 causes the valve 80 to open, supplying gas to the burner 24.

Upon closing of valve 40 (or normally-open valve 30), the supply of gas to chamber 70 is discontinued. Consequently, the pressure acting against the underside of diaphragm 68 is relieved and the diaphragm moves downwardly under the influence of gravity and the compression spring 90. Downward movement continues until valve 80 seats against outlet 76 completely blocking the flow of gas through outlet 76. At this point, the dampers are still in a full open position. However, downward movement of the damper 68 can continue at a controlled rate by virtue of a bleed line 100 which extends from chamber 70 to a vent pilot 102. The rate at which the gas is allowed to vent can be varied by changing a flow orifice member 104 positioned in the vent pilot 102. Additionally, a second small vent line 106 extends from chamber 72 to pilot 26 to relieve pressure within chamber 72 and to provide a safe discharge of gas if the diaphragm should rupture. The final downward movement of the diaphragm 68 causes the damper members 52, 54 to move to their final closed positions shown in FIG. 1.

Because the dampers 52, 54 are closed, there can be no thermosyphonic action producing a flow of air through the vent tube 22 to cause cooling of the water within the tank 16. Additionally, since the draft hood 48 is also closed, building air cannot circulate up the chimney or stack to cause additional heat losses. It should be noted that small holes 120, 122 are provided in dampers 52 and 54 to allow combustion gases from the pilot to exhaust when the unit is in standby condition. The holes are, however, sized sufficiently small to prevent any substantial heat loss due to cooling of the heated water.

It is important to note that the entire apparatus operates without the necessity of a separate electrical power supply or any other outside power source. All operation is achieved merely through the pressure of the fluid fuel being supplied through line 32.

While the system has been described with reference to a gas-fired water heater, it is, of course, obvious that the invention could equally well be applied to any pressurized fluid fuel system on substantially any type of heating apparatus including furnaces and the like.

The invention has been described in great detail sufficient to enable one of ordinary skill in the art to make and use the same. Obviously, modifications and alterations of the preferred embodiment will occur to others upon a reading and understanding of the specification and it is my intention to include all such modifications and alterations as part of my invention insofar as they come within the scope of the appended claims.

The invention claimed is:

1. In a heating apparatus of the type including a fluid fuel burner, a flue duct for discharging the products of combustion produced by said burner, a supply line for supplying fluid fuel to said burner and a valve means operable between open and closed positions for controlling the flow of fuel through said supply line to said burner, the improvement comprising:

at least one damper means movable between open and closed positions for controlling flow through said flue duct;

expansible chamber fluid motor means connected to said flow control damper means for moving said damper means to an open position when pressurized and to a closed position when unpressurized; and, connection means for pressurizing said expansible chamber motor means whenever said valve means is in an open position, and said expansible chamber motor means including control means for preventing the flow of fuel to said burner until said damper means are in an open position.

2. The improvement as defined in claim 1 wherein said control means comprises a valve driven by said expansible chamber motor means.

3. The improvement as defined in claim 1 wherein said expansible chamber motor means comprises a movable diaphragm forming a wall of said chamber, said chamber being connected for pressurization by said fuel whenever said valve is in an open position.

4. The improvement as defined in claim 3 wherein said diaphragm is mechanically linked to said control means.

5. The improvement as defined in claim 3 wherein said control means comprises a valve element linked to said diaphragm.

6. The improvement as defined in claim 1 wherein said control means comprises a valve in said supply line opened after said damper means moves to an open position.

7. In a heating apparatus including a fuel burner, a supply line for conducting fuel to the burner, a first valve for controlling flow through the supply line to the burner and a vent duct for conducting the products of combustion from the burner to a location exterior of the apparatus, the improvement comprising:

a damper means mounted for movement between a first position to permit flow through the vent duct and a second position to block flow through the vent duct;

an expansible chamber motor means positioned in said supply line between said valve and said burner and including a wall portion movable from a first to a second position when said chamber is pressurized by fuel flowing to said chamber upon opening of said first valve;

a second valve means located in said supply line between said first valve and said burner; and, mechanical drive means interconnecting said movable wall means and said damper means for actuating said damper means to said first position when said wall means moves to said first position, said second valve means being connected to open only when said damper means moves to said first position.

8. The improvement as defined in claim 7 including a bleed line connected to said chamber for depressurizing said chamber when said first valve is closed.

9. The improvement as defined in claim 7 wherein said apparatus includes a draft hood for receiving the products of combustion from said vent and wherein said damper means includes means for controlling flow from said vent through said draft hood.

10. In a heating apparatus of the type including a fluid fuel burner, a flue duct for discharging the products of combustion produced by said burner and a valve means operable between open and closed positions for controlling the flow of fuel through said supply line to said burner, the improvement comprising:

at least one damper means movable between open and closed positions for controlling flow through said flue duct;

fluid motor means connected to said damper means for moving said damper means to an open position and to a closed position; and, connection means for pressurizing said fluid motor means whenever said valve means is in an open position, and control means for preventing the flow of fuel to said burner until said damper means are in an open position.

11. The improvement as defined in claim 10 wherein said fluid motor means comprises a chamber and a movable diaphragm forming a wall of said chamber, said chamber being connected for pressurization by said fuel whenever said valve is in an open position.

12. The improvement as defined in claim 11 wherein said diaphragm is mechanically linked to said control means.

13. The improvement as defined in claim 11 wherein said control means comprises a valve element linked to said diaphragm.

14. In a heating apparatus including a fuel burner, a supply line for conducting fuel to the burner, a first valve for controlling flow through the supply line to the burner and a vent duct for conducting the products of combustion from the burner to a location exterior of the apparatus, the improvement comprising:

a damper means mounted for movement between a first position to permit flow through the vent duct and a second position to block flow through the vent duct;

a fluid motor means positioned in said supply line between said valve and said burner and including a portion movable from a first to a second position when said motor is pressurized by fuel flowing thereto upon opening of said first valve;

a second valve means located between said first valve and said burner; and, mechanical drive means interconnecting said portion and said damper means for actuating said damper means to said first position and said second position, said second valve means being connected to open only when said damper means are in said first position.

* * * * *